US012760901B2

(12) United States Patent
Yang et al.

(10) Patent No.: US 12,760,901 B2
(45) Date of Patent: Oct. 13, 2026

(54) MOVABLY INSTALLED EJECTOR PIPE FOR GAS FIREPLACE

(71) Applicant: NINGBO RICHEN ELECTRICAL APPLIANCE CO., LTD, Ningbo (CN)

(72) Inventors: Pengju Yang, Ningbo (CN); Yin Zhou, Ningbo (CN)

(73) Assignee: NINGBO RICHEN ELECTRICAL APPLIANCE CO., LTD, Ningbo (CN)

( * ) Notice: Subject to any disclaimer, the term of this patent is extended or adjusted under 35 U.S.C. 154(b) by 332 days.

(21) Appl. No.: 18/648,831

(22) Filed: Apr. 29, 2024

(65) Prior Publication Data

US 2024/0384875 A1 Nov. 21, 2024

(30) Foreign Application Priority Data

May 17, 2023 (CN) ..... 202321193027.8

(51) Int. Cl.
*F24B 1/199* (2006.01)
*F23D 14/64* (2006.01)

(52) U.S. Cl.
CPC ..... *F24B 1/199* (2013.01); *F23D 14/64* (2013.01); *F23D 2203/007* (2013.01); *F23D 2900/21004* (2013.01)

(58) Field of Classification Search
CPC ..... F23D 14/64; F23D 2203/007; F23D 2900/21004; F24B 1/199; F24C 3/006
See application file for complete search history.

(56) References Cited

FOREIGN PATENT DOCUMENTS

| | | | | | |
|---|---|---|---|---|---|
| CN | 111442268 A | * | 7/2020 | ..... | F23F 14/04 |
| CN | 114110584 A | * | 3/2022 | ..... | F23D 14/06 |
| CN | 223020270 U | * | 6/2025 | | |
| FR | 1447781 A | * | 7/1966 | | |
| GB | 2599454 A | * | 4/2022 | ..... | F23D 14/46 |

* cited by examiner

*Primary Examiner* — Ngoc T Nguyen
(74) *Attorney, Agent, or Firm* — Carter, DeLuca & Farrell LLP; George Likourezos

(57) ABSTRACT

Disclosed in the present disclosure is a movably installed ejector pipe for a gas fireplace, the nozzle and the limit seat are fixed to the substrate, the ejector pipe is inserted between the limit seat and the nozzle, the limit seat is provided inside with a first inner bore and a second inner bore of a stepped shape, the first inner bore is below the second inner bore and is larger than the second inner bore, a head of the ejector pipe is provided with a groove. In the gas fireplace provided in the present disclosure, because a limit seat is added, the ejector pipe can swing at a certain angle within the limit seat, so that a placing angle of a burner can be finely adjusted and thereby the burner is in a position that allows for the optimal viewing effect of flame combustion.

7 Claims, 3 Drawing Sheets

MOVABLY INSTALLED EJECTOR PIPE FOR GAS FIREPLACE

TECHNICAL FIELD

The present disclosure relates to the technical field of ejector pipes for gas fireplaces, and in particular to a movably installed ejector pipe for a gas fireplace.

BACKGROUND ART

As a heating unit using clean energy, a gas fireplace not only provides a sufficient heating effect, but also provides a real flame for viewing as compared with a heater such as a wall hanging stove, so it is popular among consumers.

However, at present, a fixed connection structure is generally used between the ejector pipe and the nozzle in the gas fireplace, and the relative position between the ejector pipe and the nozzle is fixed and cannot be adjusted. However, most burners on the existing gas fireplaces have an integral welding structure, and due to manufacturing error and welding distortion, the position and/or angle of the ejector pipe on the burner is usually not exactly the same as expected. At this time, when the ejector pipe is fixedly connected to the nozzle, the burner will be skewed since the nozzle is already fixed to the product in advance.

In addition, in some gas fireplace products, the burner may be directly embedded in the simulated solid combustion. Due to existing technical restrictions in the manufacturing of simulated solid fuel, the relative position between the burner and the simulated solid fuel is also inaccurate, and there is an error offset within a certain range. In this case, when the ejector pipe and the nozzle are installed in a fixed relative positional relationship, the simulated solid fuel may be placed in a skewed way, which may affect the flame combustion effect.

Content of Disclosure

(I) Technical Problem to be Solved

The problem to be solved by the present disclosure is to provide a movably installed ejector pipe for a gas fireplace, so as to overcome the defects of the prior art that the ejector pipe for a gas fireplace is difficult to install and prone to have error offset due to the inability to movably install it.

(II) Technical Solution

In order to solve the technical problem, the present disclosure provides a movably installed ejector pipe for a gas fireplace, which comprises a nozzle, an ejector pipe, a limit seat, a flexible sealing ring, and a substrate; the substrate is provided with a nozzle fixing hole, and the nozzle is fixed in the nozzle fixing hole in a certain manner; the limit seat is a hollow structure, and inner bores thereof are of a stepped shape, including a first inner bore and a second inner bore; the first inner bore is below the second inner bore, a diameter of the first inner bore is larger than that of the second inner bore, and the limit seat is sleeved on the nozzle and fixed by the substrate; the flexible sealing ring is provided inside the first inner bore, and the flexible sealing ring provided on the first inner bore by being in an interference fit therewith; the ejector pipe is inserted between the limit seat and the flexible sealing ring, an outer diameter of the ejector pipe is larger than an inner diameter of the flexible sealing ring, and the outer diameter of the ejector pipe is smaller than an inner diameter of the second inner bore, that is, a gap is formed between an outer surface of the ejector pipe and an inner surface of the second inner bore.

Further, in order to prevent the ejector pipe from coming out of the limit seat after the ejector pipe has been installed, a head of the ejector pipe is provided with a groove, the flexible sealing ring is fitted into the groove, and an outer diameter of the groove is larger than the inner diameter of the flexible sealing ring, that is, there is an interference fit between the groove and the flexible sealing ring.

Further, a size of the gap formed between the outer diameter of the ejector pipe and the second inner bore is 0.2 mm to 2.5 mm.

Further, the movably installed ejector pipe for a gas fireplace further comprises a burner, the burner is provided with a gas inlet, an extension section is provided on an upper half of the ejector pipe, and the gas inlet is sleeved on the extension section; the ejector pipe and the burner are two separate components, and the structure of the two being sleeved with each other facilitates maintenance and replacement of the burner at a later stage.

Further, a stop end face is formed between the extension section of the ejector pipe and a lower half of the ejector pipe, the gas inlet on the burner is sleeved on the extension section, and the stop end face positions a sleeving depth of the gas inlet.

Further, the gas inlet is sleeved on the extension section, an inner diameter of the air inlet is larger than an outer diameter of the extension section, and a certain gap is inevitably formed between the air inlet and the extension section; in order to avoid the influence on the primary air intake effect by air leakage from the gap between the air inlet and the extension section, a sealing gasket made of a soft material is provided between the stop end face and an end surface of the air inlet.

Further, the ejector pipe is provided with several air intake holes, and the air intake holes are located above the limit seat.

In the above technical solutions, the several means one or more than one.

Basic Principle of the Present Disclosure

At the time of assembling the structure of the present disclosure, first, the nozzle is fixed to and integrally assembled with the substrate, then the flexible sealing ring is fitted into the groove of the ejector pipe, then the ejector pipe is allowed to entirely pass through the first inner bore and the second inner bore of the limit seat, and then the limit seat is fixed to the substrate, thus completing the installation of the ejector pipe. Since the flexible sealing ring is in an interference fit with both the first inner bore and the groove, the sealing between the limit seat and the ejector pipe is ensured; besides, a certain gap is present between the ejector pipe and the second inner bore, so that the ejector pipe can swing within the range of the second inner bore, and thereby a placing angle of the burner can be adjusted.

After the ejector pipe has been installed, the sealing gasket is sleeved on the extension section of the ejector pipe, and then the gas inlet of the burner is sleeved on the extension section and pressed against the sealing gasket; since the ejector pipe can swing to some extent, the placing angle of the burner can be finely adjusted according to a swing angle of the ejector pipe, so that the burner is placed in a state for optimal effect.

During operation, combustible gas ejected at high speed from the nozzle flows upward in the ejector pipe to form a high-speed and low-pressure state in the ejector pipe, so that ambient air outside the ejector pipe is sucked into the ejector pipe through the primary air intake holes, the air introduced from the primary air intake holes is mixed with the combustible gas, and the two are introduced into the gas inlet of the burner together, thereby performing combustion; due to the presence of the flexible sealing ring and the sealing ring, effective sealing can be achieved between the ejector pipe, the limit seat, and the gas inlet, without affecting the total amount of primary intake air entering the ejector pipe specified by the design, so that the combustion of the gas on the burner is smooth, controllable, and sufficient.

(III) Beneficial Effects

Compared with the prior art, the advantageous effects of the present disclosure are as follows:

In the movably installed ejector pipe for a gas fireplace provided in the present disclosure, because a limit seat is added, the ejector pipe can swing at a certain limited angle within the limit seat, so that a placing angle of a burner can be finely adjusted and thereby the burner is in a position that allows for the optimal viewing effect of flame combustion; besides, the present disclosure features simple manufacturing structure and enables convenient replacement of the burner by a customer, and the amount of primary intake air for assisting the combustion is generally controllable and the combustion is more sufficient and safer.

Figure 1:
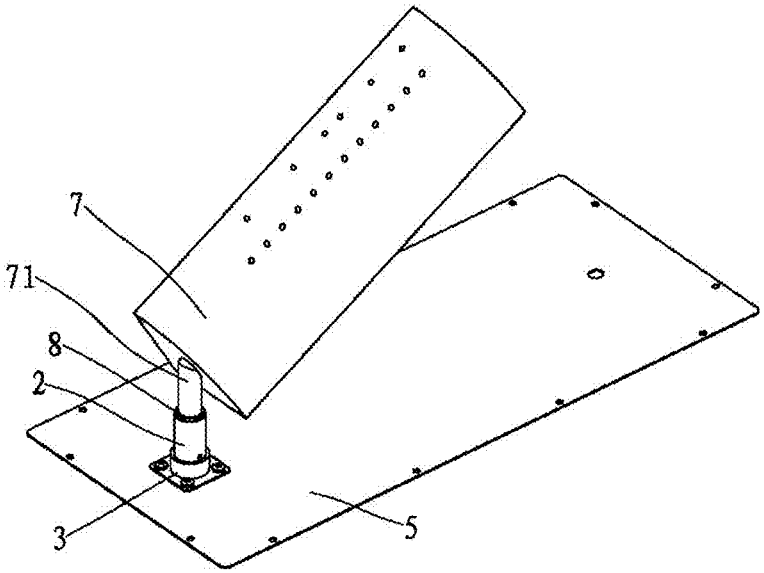
FIG. 1 is a three-dimensional view of a movably installed ejector pipe for a gas fireplace according to the present disclosure.

The names of the components corresponding to the respective reference numerals in the figures are as follows:

1—nozzle; 2—ejector pipe; 21—groove; 22—air intake hole; 23—extension section; 24—stop end face; 3—limit seat; 31—first inner bore; 32—second inner bore; 4—flexible sealing ring; 5—substrate; 51—nozzle fixing hole; 6—nut; 7—burner; 71—gas inlet; 8—sealing gasket.

DETAILED DESCRIPTION

Specific implementations of the present disclosure will be further described in detail below with reference to the accompanying drawings and embodiments. The following embodiments are used to illustrate the present disclosure, but are not intended to limit the scope of the present disclosure.

Figure 2:
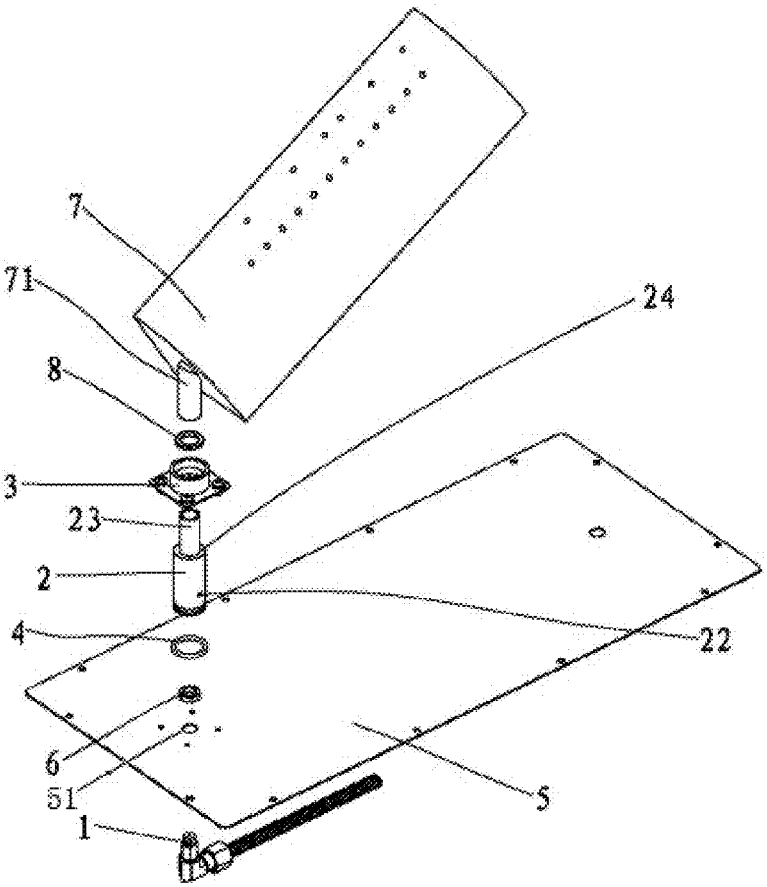
FIG. 2 is an exploded view of a movably installed ejector pipe for a gas fireplace according to the present disclosure.
Figure 3:
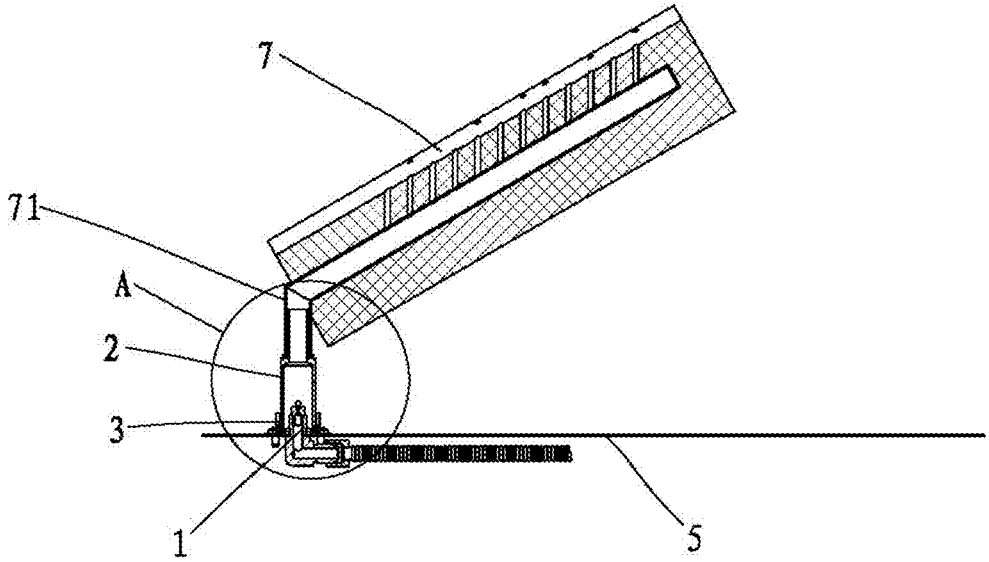
FIG. 3 is a semi-sectional view of a movably installed ejector pipe for a gas fireplace according to the present disclosure.
Figure 4:
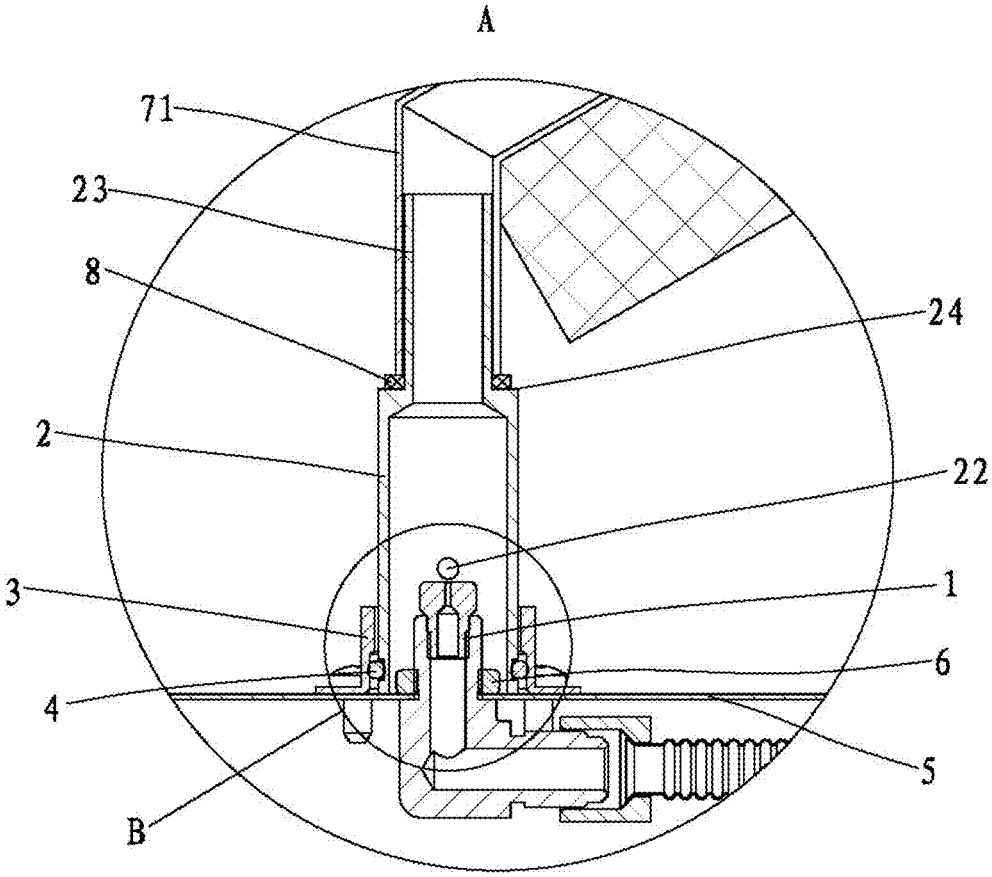
FIG. 4 is an enlarged view of part A in FIG. 3 of a movably installed ejector pipe for a gas fireplace according to the present disclosure.
Figure 5:
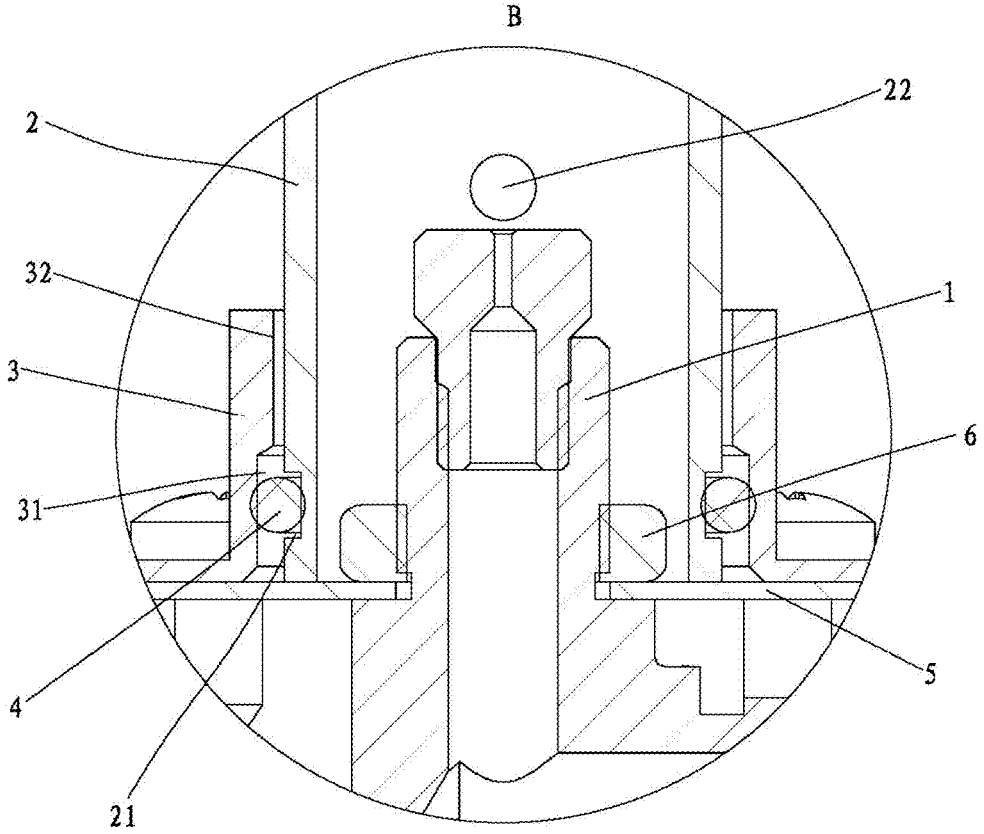
FIG. 5 is an enlarged view of part B in FIG. 4 of a movably installed ejector pipe for a gas fireplace according to the present disclosure.
Figure 6:
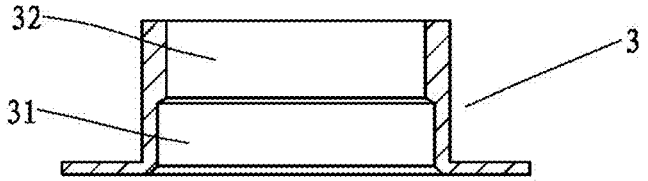
FIG. 6 is a cross-sectional view of a limit seat of a movably installed ejector pipe for a gas fireplace according to the present disclosure.
Figure 7:
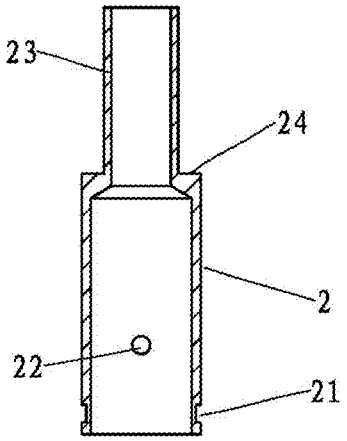
FIG. 7 is a cross-sectional view of an ejector pipe of a movably installed ejector pipe for a gas fireplace according to the present disclosure.

Referring to FIGS. 1 to 7, a movably installed ejector pipe for a gas fireplace comprises a nozzle 1, an ejector pipe 2, a limit seat 3, a flexible sealing ring 4, and a substrate 5; the substrate 5 is provided with a nozzle fixing hole 51, and the nozzle 1 is locked and fixed in the nozzle fixing hole 51 by a nut 6; the limit seat 3 is a hollow structure having inner bores of a stepped shape, including a first inner bore 31 and a second inner bore 32; the first inner bore 31 is below the second inner bore 32, a diameter of the first inner bore 31 is larger than that of the second inner bore 32, and the limit seat 3 is sleeved around the nozzle 1 and fixed by the substrate 5; the flexible sealing ring 4 is provided inside the first inner bore 31, and an outer diameter of the flexible sealing ring 4 is larger than an inner diameter of the first inner bore 31, so that an interference fit can be achieved; the ejector pipe 2 is inserted between the limit seat 3 and the nozzle 1, a head of the ejector pipe 2 is provided with a groove 21, the flexible sealing ring 4 is fitted into the groove 21, and an outer diameter of the groove 21 is larger than an inner diameter of the flexible sealing ring 4, that is, there is an interference fit between the groove 21 and the flexible sealing ring 4; in addition, an outer diameter of the ejector pipe 2 is smaller than an inner diameter of the second inner bore 32, that is, a gap is formed between the outer diameter of the ejector pipe 2 and the inner diameter of the second inner bore 32; in this embodiment, a size of the gap formed between an outer surface of the ejector pipe 2 and an inner surface of the second inner bore 32 is 0.2 mm to 2.5 mm, and the optimal value thereof is 0.4 mm; in this embodiment, the ejector pipe 2 is also provided with two symmetrically arranged air intake holes 22, and the air intake holes 22 are higher than the limit seat 3, that is, the limit seat 3 does not block the air inflow of the air intake holes 22.

This embodiment also comprises a burner 7 and a sealing gasket 8, the burner 7 is provided with a gas inlet 71, and an outside of the burner 7 is provided to have an appearance of simulated solid fuel; an extension section 23 is provided on an upper half of the ejector pipe 2, the gas inlet 71 is sleeved on the extension section 23, a stop end face 24 is formed between the extension section 23 and a lower half of the ejector pipe 2, a sealing gasket 8 is sleeved on the extension section 23 and is in tight contact with the stop end face 24, the sealing gasket 8 is made of a soft material, the gas inlet 71 is sleeved on the extension section 23 and is pressed against the sealing gasket 8, and a connection part between the gas inlet 71 and the extension section 23 is sealed by the sealing gasket 8.

Installation process and operation principle of the movably installed ejector pipe for a gas fireplace in this embodiment:

At the time of assembling, first, the nozzle 1 is allowed to pass through the nozzle fixing hole 51 of the substrate 5, the nozzle 1 is fixed to and integrally assembled with the substrate 5 by the nut 6, then the flexible sealing ring 4 is fitted into the groove 21 of the ejector pipe 2, then the ejector pipe 2 is allowed to entirely pass through the first inner bore 31 and the second inner bore 31 of the limit seat 3, and then the limit seat 3 is fixed to the substrate 5, thus completing the installation of the ejector pipe 2. Since the flexible sealing ring 4 is in an interference fit with both the first inner bore 31 and the groove 21, the sealing between the limit seat 3 and the ejector pipe 2 is ensured; besides, a 0.4 mm gap is present between the ejector pipe 2 and the second inner bore 32, so that the ejector pipe 2 can swing within the range of the second inner bore 32, and thereby a placing angle of the burner 7 can be adjusted.

After the ejector pipe 2 has been installed, the sealing gasket 8 is sleeved on the extension section 23 of the ejector pipe 2, and then the gas inlet 71 of the burner 7 is sleeved on the extension section 23 and pressed against the sealing gasket 8. Since the ejector pipe 2 can swing to some extent, the placing angle of the burner 7 can be finely adjusted according to a swing angle of the ejector pipe 2, so that the burner 7 is placed in a state for optimal effect.

When the ejector pipe of this embodiment is in operation, combustible gas ejected at high speed from the nozzle 1 flows upward in the ejector pipe 2 to form a high-speed and low-pressure state in the ejector pipe 2, so that ambient air outside the ejector pipe 2 is sucked into the ejector pipe 2 through the primary air intake holes 22, the air introduced from the primary air intake holes 22 is mixed with the combustible gas, and the two are introduced into the gas inlet 71 of the burner 7 together, thereby performing combustion. Due to the presence of the flexible sealing ring 4 and the sealing ring 7, effective sealing can be achieved between the ejector pipe 2, the limit seat 3, and the gas inlet 71, without affecting the total amount of primary intake air entering the ejector pipe 2 specified by the design, so that the combustion of the gas on the burner 7 is smooth, controllable, and sufficient.

The above description does not limit the present disclosure, and the present disclosure is not limited to the above examples. Changes, modifications, additions, or substitutions made by those of ordinary skill in the art within the essence of the present disclosure shall also fall within the protection scope of the present disclosure.

The invention claimed is:

1. A movably installed ejector pipe for a gas fireplace, comprising a nozzle, an ejector pipe, a limit seat, a flexible sealing ring, and a substrate, wherein the substrate is provided with a nozzle fixing hole, and the nozzle is fixed in the nozzle fixing hole; the limit seat has hollow inner bores arranged in a stepped shape, a first inner bore and a second inner bore are formed, the first inner bore is below the second inner bore, a diameter of the first inner bore is larger than that of the second inner bore, and the limit seat is sleeved on the nozzle and fixed by the substrate; the flexible sealing ring is provided on the first inner bore by being in an interference fit therewith; the ejector pipe is inserted between the limit seat and the flexible sealing ring, and an outer diameter of the ejector pipe is larger than an inner diameter of the flexible sealing ring and smaller than an inner diameter of the second inner bore, that is, a gap is formed between an outer surface of the ejector pipe and an inner surface of the second inner bore.

2. The movably installed ejector pipe for a gas fireplace according to claim 1, wherein a head of the ejector pipe is provided with a groove, the flexible sealing ring is fitted into the groove, and an outer diameter of the groove is larger than the inner diameter of the flexible sealing ring.

3. The movably installed ejector pipe for a gas fireplace according to claim 1, wherein the gap formed between the outer surface of the ejector pipe and the inner surface of the second inner bore has a width of 0.2 mm to 2.5 mm.

4. The movably installed ejector pipe for a gas fireplace according to claim 1, further comprising a burner, wherein the burner is provided with a gas inlet; an extension section is provided on an upper half of the ejector pipe, and the gas inlet is sleeved on the extension section.

5. The movably installed ejector pipe for a gas fireplace according to claim 4, wherein a stop end face is formed between the extension section on the ejector pipe and a lower half of the ejector pipe.

6. The movably installed ejector pipe for a gas fireplace according to claim 5, wherein a sealing gasket made of a soft material is provided between the stop end face and an end face of the gas inlet.

7. The movably installed ejector pipe for a gas fireplace according to claim 1, wherein the ejector pipe is provided with several air intake holes, and the air intake holes are located above the limit seat.

* * * * *